US006374747B1

(12) United States Patent
Devnani et al.

(10) Patent No.: US 6,374,747 B1
(45) Date of Patent: Apr. 23, 2002

(54) SOUND ABATEMENT METHODS AND CONVEYOR TROLLEYS

(75) Inventors: Deepak Devnani, Waterford; Christopher M. Ariss, Fenton; Craig R. Smith, Milford, all of MI (US)

(73) Assignee: Jervis B. Webb Company, Farmington Hills, MI (US)

( * ) Notice: Subject to any disclaimer, the term of this patent is extended or adjusted under 35 U.S.C. 154(b) by 0 days.

(21) Appl. No.: 09/564,809

(22) Filed: May 5, 2000

Related U.S. Application Data

(60) Provisional application No. 60/132,725, filed on May 6, 1999.

(51) Int. Cl.[7] ..... B61B 10/02; B61B 7/00

(52) U.S. Cl. ..... 104/162; 104/172.1; 104/172.3; 104/172.4

(58) Field of Search ..... 104/162, 172.3, 104/172.4, 172.1

(56) References Cited

U.S. PATENT DOCUMENTS

| | | | | |
|---|---|---|---|---|
| 2,001,855 A | | 5/1935 | Spencer | |
| 2,115,064 A | | 4/1938 | Dwyer | |
| 2,164,859 A | | 7/1939 | Willoughby | |
| 3,011,457 A | | 12/1961 | Péras | |
| 3,083,650 A | | 4/1963 | Péras | |
| 3,178,035 A | | 4/1965 | Peterson | |
| 3,216,590 A | | 11/1965 | Bateson | |
| 3,223,049 A | | 12/1965 | Peterson | |
| 3,284,122 A | | 11/1966 | Rich | |
| 3,294,254 A | | 12/1966 | DeMent | |
| 3,451,353 A | | 6/1969 | Bishop | |
| 3,467,023 A | | 9/1969 | Dodds et al. | |
| 3,559,585 A | | 2/1971 | Lempio | |
| 3,559,586 A | * | 2/1971 | Follrath | 104/172.4 |
| 3,664,267 A | | 5/1972 | DiRosa | |
| 3,675,587 A | | 7/1972 | Zetterlund et al. | |
| 3,720,172 A | | 3/1973 | Dehne | |
| 3,721,433 A | | 3/1973 | Sobel | |
| 3,726,234 A | | 4/1973 | Dema et al. | |
| 3,774,546 A | * | 11/1973 | Krammer | 104/172.4 |
| 3,799,327 A | * | 3/1974 | Schulz | 198/170 |
| 3,810,428 A | | 5/1974 | Klamp | |
| 3,818,840 A | | 6/1974 | Dehne | |
| 3,876,082 A | | 4/1975 | Fehl et al. | |
| 3,902,430 A | | 9/1975 | Ott et al. | |
| 3,926,125 A | | 12/1975 | Orwin | |
| 3,948,186 A | | 4/1976 | McCaul | |
| 4,058,064 A | | 11/1977 | Wilder et al. | |
| 4,122,778 A | | 10/1978 | DiRosa | |
| 4,314,512 A | | 2/1982 | Gerhard et al. | |

(List continued on next page.)

FOREIGN PATENT DOCUMENTS

| | | |
|---|---|---|
| GB | 2 099 771 A | 2/1982 |
| GB | 2 210 008 A | 6/1989 |
| GB | 2 292 131 A | 2/1996 |

*Primary Examiner*—Joseph D. Pape
*Assistant Examiner*—Greg Blankenship
(74) *Attorney, Agent, or Firm*—Dickinson Wright PLLC

(57) ABSTRACT

A sound abatement method includes applying a sound abating material to at least one area of at least one component of the moving trolley. A sound abatement conveyor trolley includes a trolley body having at least one wheel for traveling in a track and one or more component cooperatively associated with the trolley body, which the components each include a sound abating material applied to the area for sound abatement. An element used in a conveyor trolley includes at least one area and a sound abating material applied to the area for sound abatement.

44 Claims, 5 Drawing Sheets

U.S. PATENT DOCUMENTS 4,395,954 A * 8/1983 Grube ..... 104/89
4,408,540 A 10/1983 Dehne
4,616,570 A 10/1986 Dehne
4,885,997 A 12/1989 Wakahayashi
4,930,618 A * 6/1990 Roh ..... 198/781
4,993,541 A * 2/1991 Roh ..... 198/781
5,285,889 A * 2/1994 McDonald ..... 198/687
5,373,952 A 12/1994 Sugiura
5,507,233 A * 4/1996 Kwon et al. ..... 104/172.4
5,511,486 A 4/1996 Pollard et al.
5,632,206 A 5/1997 Summa et al.
5,823,116 A * 10/1998 Williams ..... 104/172.5
5,839,371 A * 11/1998 Knuttel ..... 104/172.4
D413,190 S 8/1999 Catanach et al.
6,003,443 A 12/1999 Kubsik et al.

* cited by examiner

A-A

B-B

C-C

A-A

B-B

C-C

D-D

SOUND ABATEMENT METHODS AND CONVEYOR TROLLEYS

This application claims the priority of U.S. provisional patent application No. 60/132,725, filed May 6, 1999, which provisional application is incorporated by reference in its entirety.

FIELD OF THE INVENTION

The present invention is directed to sound abatement methods and conveyor trolleys, and, in particular, to methods and conveyor trolleys whereby a sound abating material is applied to certain areas of trolley components to reduce the noise generated by collision between two trolleys.

BACKGROUND ART

Power and free conveyors are made up of a power track, a free track and a number of carriers traveling along the free track. Each carrier includes leading and trailing trolleys, and the trolleys are placed on the free track and support the carrier. The power track includes a power chain that travels along the power track. Frequently, the power and free tracks are arranged adjacent to each other and in parallel. Each leading trolley may include a retractable dog which extends toward the power track and which is engageable by a pusher dog carried by the moving power chain in the power track. When the pusher dog engages the retractable dog, the trolley, and thus the carrier, is pushed by the moving power chain to travel along the free track. When the retractable dog is retracted, or otherwise disengaged from the pusher dog, the trolley loses power and stops moving.

One of the advantages of the power and free conveyors is that the conveyors allow accumulation of carriers. Power and free conveyors often include one or more accumulation sections where a number of stopped carriers are stored in a closely spaced or contacting relationship until they are needed. In order to stop and accumulate a moving carrier, the leading trolley of the moving carrier is made to collide with the trailing trolley of a downstream stopped carrier. As the two trolleys collide, the cam lever of the leading trolley of the carrier strikes the accumulation cam of the trailing trolley of another carrier, causing the cam lever to raise the retractable dog of the leading trolley. Retracting the retractable dog disengages the retractable dog from the pusher dog so that the leading trolley, and thus the moving carrier, is no longer driven by the moving power chain.

Such collisions often generate loud noises. A carrier is made of metals and metal alloys and may carry a heavy workpiece, and thus is quite heavy. Consequently, a moving carrier possesses a large mount of kinetic energy, and this energy must be dissipated in order to stop the carrier. Because the carriers and trolleys are made from metal and metal alloys, a significant amount of energy from each collision is dissipated as sound waves. Since a conveyor line may have multiple accumulation sections and a plant may have multiple conveyor lines, the noises generated by the accumulation of carriers are substantial and frequent. The noises can be unpleasant and may have adverse health effects on employees working in the vicinity of accumulation sections.

In view of the adverse effects caused by the noises, a need has developed to provide improvements in sound abatement in connection with trolley operation.

SUMMARY OF THE INVENTION

It was found that, although a significant portion of the noise is caused by the direct collision between the body of the leading trolley and the body of the trailing trolley, other contacts among trolley components may also generate noises. In many applications, a relatively large portion of the noise is generated by the contacts among components of the leading trolley and between certain components of the leading trolley and certain components of the trailing trolley. For example, a relatively large portion of the noise may be generated by the contacts between the cam lever of the leading trolley and the accumulation cam of the trailing trolley, between the cam lever and the body of the leading trolley, between the cam lever and the retractable dog of the leading trolley, between the retractable dog and the body of the leading trolley and the contact between the retractable dog and the pusher dog during the retraction of the retractable dog from the pusher dog. There contacts include both direct and sliding contacts.

It was discovered that the application of sound abating materials to the areas where these contacts take place can reduce the noise level generated during trolley collisions. These areas may include areas on the trolley components, including the trolley body, cam lever and retractable dog of the leading trolley, as well as the accumulation cam of the trailing trolley. It was also discovered that sound abating effects may be achieved by applying sound abating materials to one or more areas of trolley components where no contact takes place. The application of the sound abating materials may include attaching the materials to these areas, including coating, gluing, frictional fit, and/or filling the cavities in these areas with the sound abating materials.

The present invention provides sound abatement methods and conveyor trolleys. According to one aspect of the invention, a method includes applying a sound abating material to at least one area of at least one component of the moving trolley.

According to another aspect of the invention, a conveyor trolley according to the present invention includes a trolley body having at least one wheel for traveling in a track and at least one component cooperatively associated with the trolley body. The component has at least one area and a sound abating material applied to the area for sound abatement.

According to a further aspect of the invention, an element used in a conveyor trolley includes at least one area and a sound abating material applied to the area for sound abatement.

DESCRIPTION OF THE PREFERRED EMBODIMENTS

The following description of the presently preferred embodiments of the invention refers to the accompanying drawings. The description is directed to and the drawings show exemplary embodiments of the invention, other embodiments are possible, and changes may be made to the embodiments described below without departing from the spirit and scope of the invention. The scope of the invention is defined by the appended claims, and the description and drawings are merely illustrative, not limiting.

Figure 2:
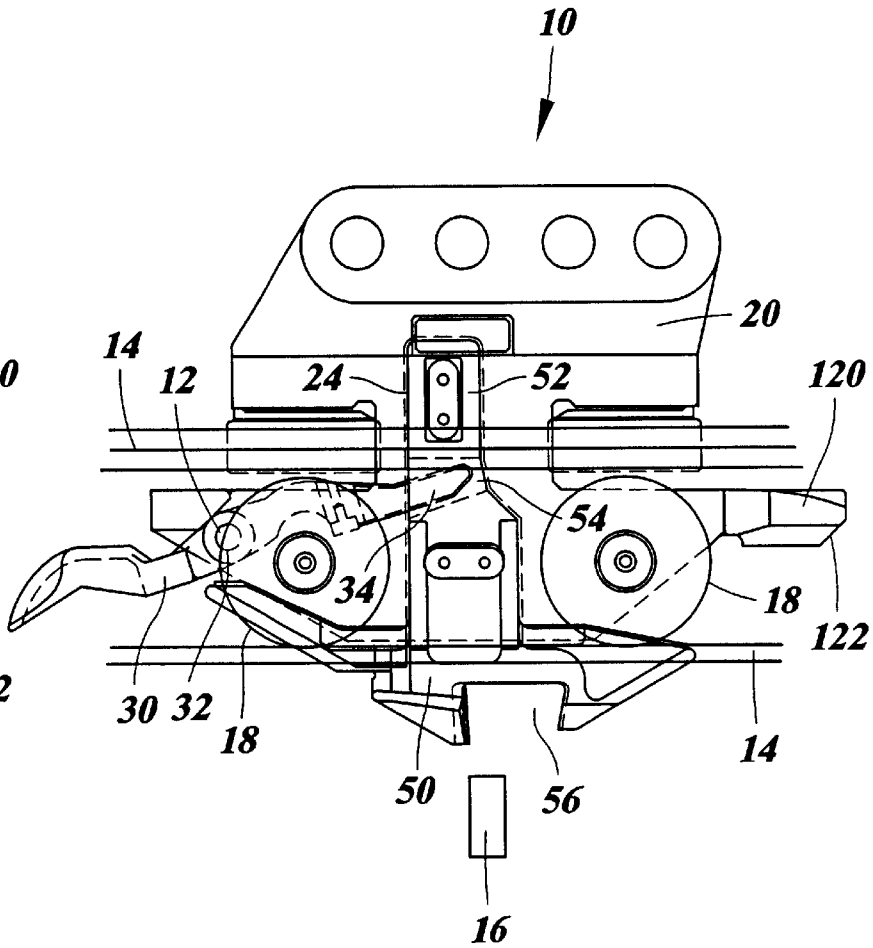
FIG. 2 shows the trolley of FIG. 1 with the retractable dog in the retracted position for disengagement with the pusher dog.
Figure 1:
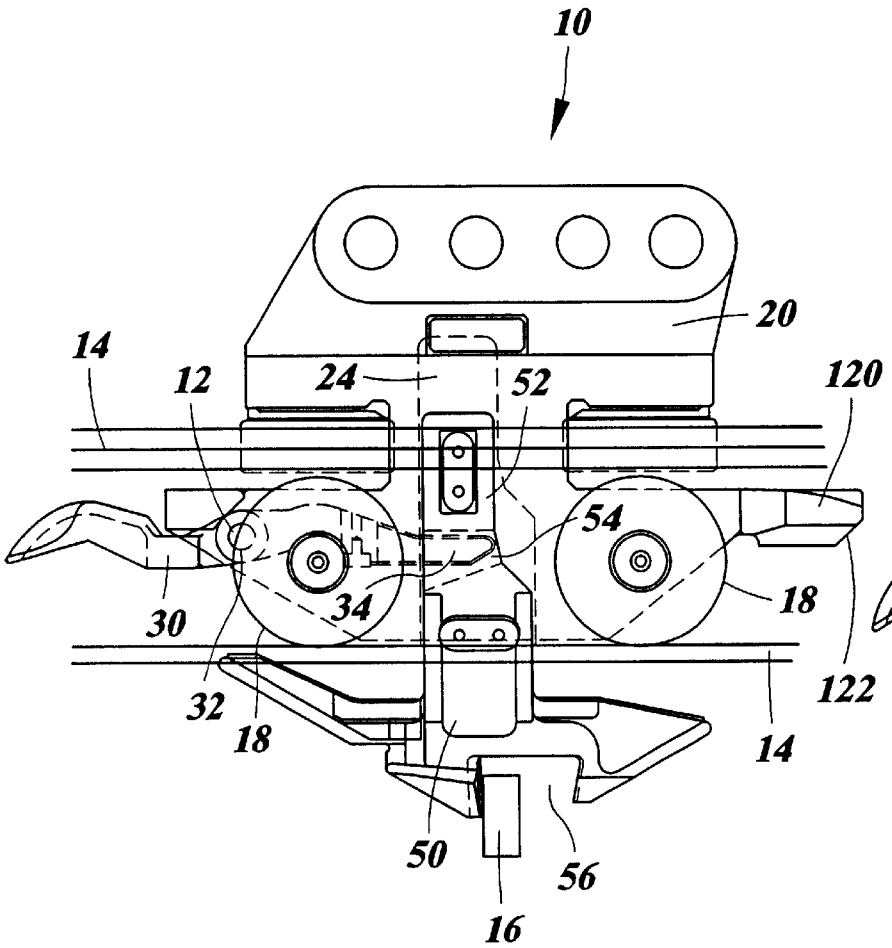
FIG. 1 shows one embodiment of a trolley according to the invention, which includes a retractable dog in the extended position for engagement with a pusher dog.

With reference to FIGS. 1 and 2, one embodiment of the invention is a trolley 10 of a carrier used in a power and free conveyor system. The trolley 10 includes one or more areas and one or more sound abating materials applied to the areas for sound abatement. The trolley 10 may be used as either a leading trolley or a trailing trolley of a carrier.

Figure 3:
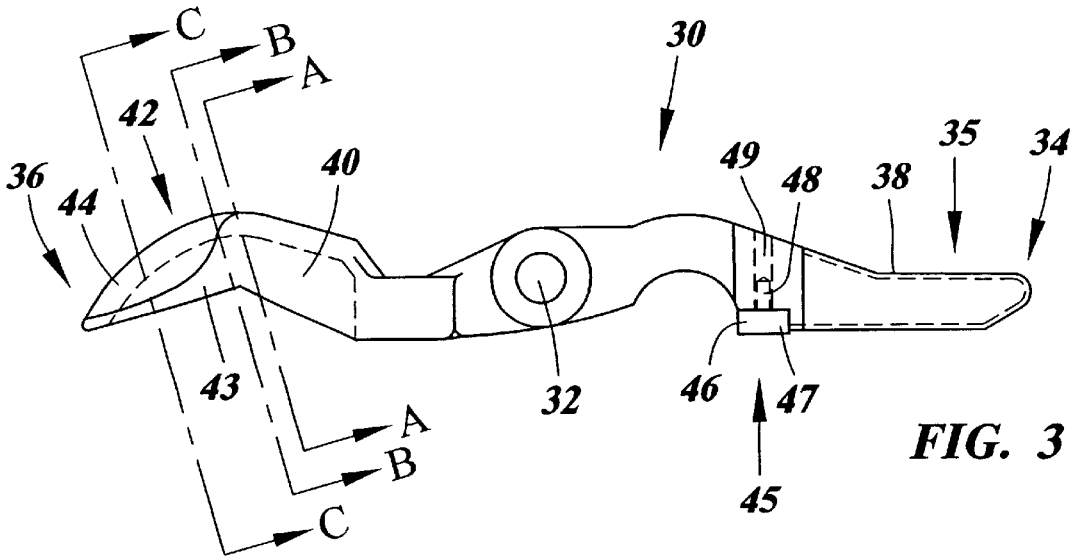
FIGS. 3 and 4 are side and top views, respectively, of the cam lever of the trolley of FIG. 1 with sound abatement features.
Figure 4:
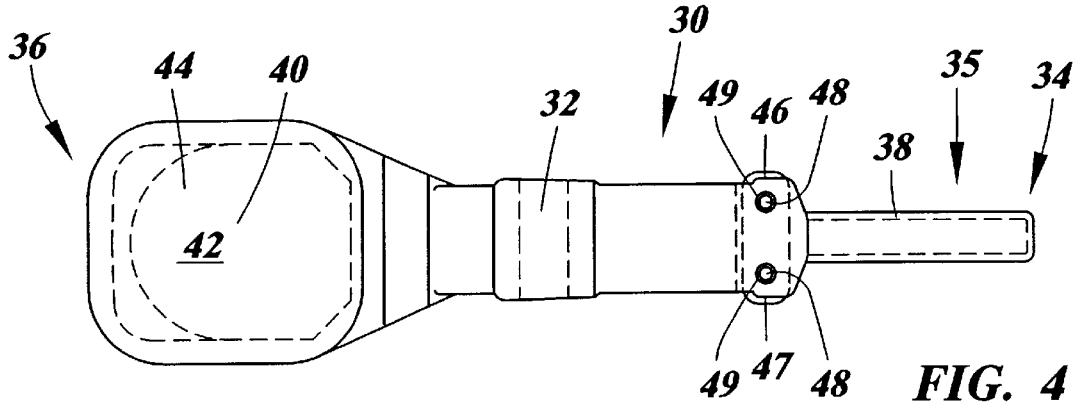

In the embodiment shown in FIGS. 1 and 2, the trolley 10 may include a trolley body 20, a cam lever 30, a retractable dog 50 and an accumulation cam 120. The trolley may include one or more components, such as a bumper. The cam lever 30 is also illustrated in FIGS. 3 and 4, and the retractable dog 50 in FIGS. 6 and 7. The cam lever 30 is mounted for pivotal movement to the trolley body 20 by a pivot pin 12 extending through a bore 32 in the cam lever 30. The retractable dog 50 preferably includes a stem 52 that is moveable within a channel 24 in the trolley body 20. The stem 52 may have an opening 54 sized to receive an end portion 34 of the cam lever 30.

In operation, the trolley 10 may be placed in the free track 14 of the power and free conveyor system and preferably has a number of wheels 18 that allow the trolley 10 to travel in the free track 14. The retractable dog 50 of the trolley 10 is engageable with any one of a number of pusher dogs 16 joined to a moving power chain (not shown). The moving power chain travels in the power track (not shown) of the conveyor system, and the power track is preferably arranged adjacent to and substantially in parallel with the free track 14. When the retractable dog 50 is engaged with a pusher dog 16, the pusher dog 16 extends into a channel 56 of the retractable dog 50 and pushes against a wing 110 of the retractable dog 50 to drive the trolley 10 in the free track 14. The wing 110 of the retractable dog 50 is better illustrated in FIG. 8.

To stop and accumulate a moving carrier, the leading trolley 10 of the moving carrier is disengaged from the pusher dog 16. To that end, the leading trolley 10 is made to collide with the trailing trolley of a stopped carrier (not shown). When the leading trolley 10 collides with the trailing trolley, an end 36 of the cam lever 30 of the leading trolley 10 contacts the accumulation cam of the trailing trolley. This contact pushes the cam lever 30 from the position shown in FIG. 1 to the position shown in FIG. 2. The pivoting action causes the retractable dog 50 to move upwardly and retract into the channel 24. The retraction of the retractable dog 50 disengages the retractable dog 50 from the pusher dog 16, allowing the pusher dog 16 to continue its travel without driving the trolley 10.

During this operation, there are a number of direct and sliding contacts among the various trolley components. For example, the cam lever 30 may contact the trolley body 20, the retractable dog 50, and the accumulation cam of the trailing trolley; and the retractable dog 50 may contact the trolley body 20 and the pusher dog 16. These contacts may increase the level of noise generated during a collision between the leading and trailing trolleys.

To reduce the level of noise generated by a collision, one or more components of the trolley 10, including the trolley body 20, the cam lever 30, the retractable dog 50, and the accumulator cam 120, may include one or more areas to which a sound abating material is applied.

Figure 5A:
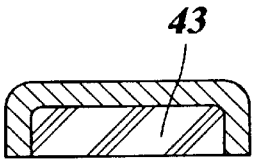
FIGS. 5A to 5C are cross section views of the sound abating material along lines A—A, B—B, and C—C of FIG. 3.
Figure 5B:
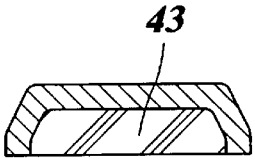
Figure 5C:
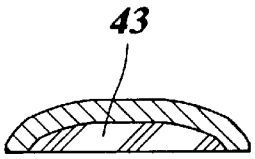

For example, as shown in FIGS. 3 and 4, the cam lever 30 may include one or more areas and a sound abating material applied thereto. The cam lever 30 may have an elongated configuration with two end portions 34, 36 and a pivot bore 32 disposed between the two end portions 34, 36. One end portion 34 of the cam lever 30 may include an area 35 and a sound abating material 38 applied to the area 35. This area 35 may extend around the entire surface of the end portion 34 and may extend a distance from the end towards the pivot bore 32. This end of the cam lever 30 extends through the opening 54 on the stem 52 of the retractable dog 50, and, during a collision, the end portion 34 of the cam lever 30 contacts the retractable dog 50 to push the retractable dog 50 upward. The other end portion 36 of the cam lever 30 may include a cavity 40 and a contact area 42. The cavity 40 is a non-contact area, i.e. the area does not come in contact with another component of the trolley 10 during a collision, and may be filled with a sound abating material 43 for noise and vibration dampening. FIGS. 5A to 5C show the cross sections of the sound abating material 43 at three locations shown in FIG. 3. The contact area 42, which contacts the accumulation cam of a trailing trolley for actuation of the cam lever 30 and retractable dog 50, may include a sound abating material 44 applied thereto.

The cam lever 30 may also include another contact area 45 to which a member 46 made of a sound abating material is applied. This area 45 of the cam lever 30 comes in contact with the trolley body 20 during a collision. The member 46 may have the configuration of a block 47 and may be applied to the area 45 in various ways. For example, as shown in FIGS. 3 and 4, the member 46 may include one or more stems 48 extending from the block 47, and the stems 48 may extend into bores 49 in the cam lever 30. An interference fit between the stems 48 and the bores 49 attaches the member 46 to the cam lever 30. With this configuration, the member 46 can be easily removed and replaced with a new one by merely pushing the stems 48 of a new member into the bores 49 once the old member is removed. Although the member 46 is attached to the cam lever 30 through an inference fit, the member 46 may be attached to the cam lever 30 using any suitable method, such as using an adhesive.

Figure 7:
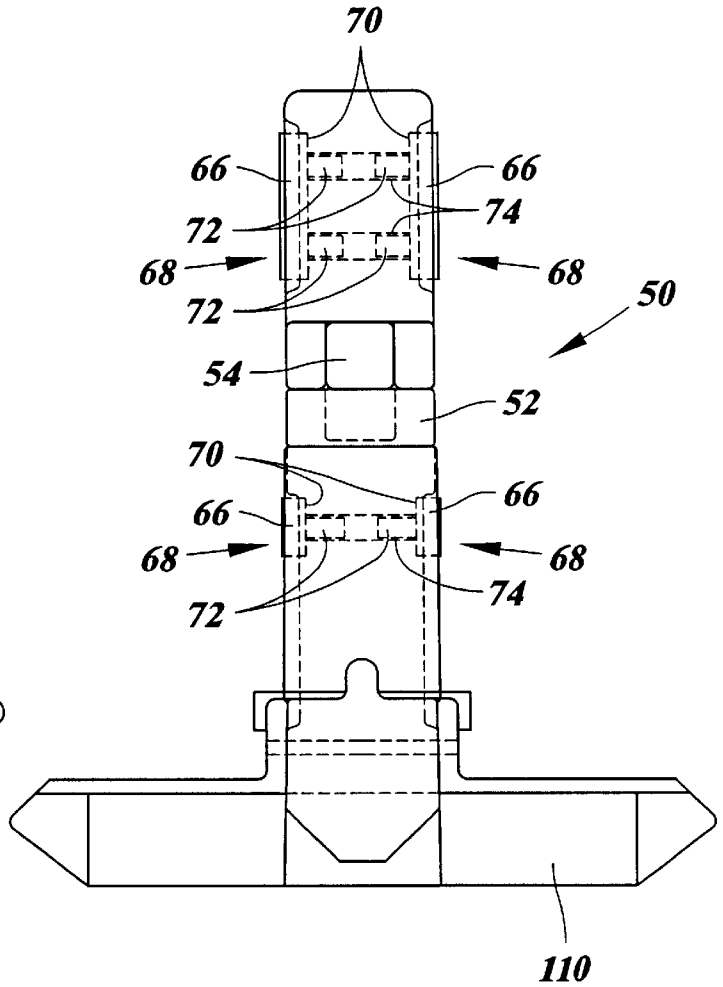
FIGS. 6, 7 and 8 are side, end and bottom views, respectively, of the retractable dog of the trolley of FIG. 1.
Figure 6:
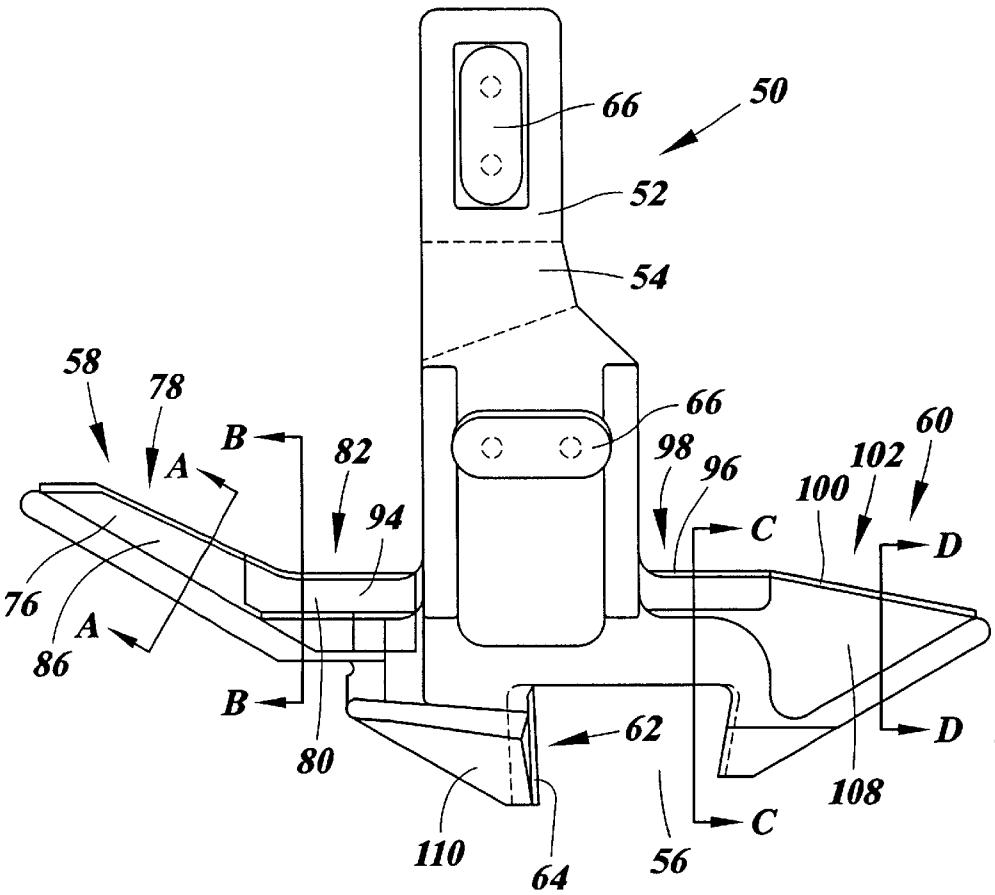
Figure 8:
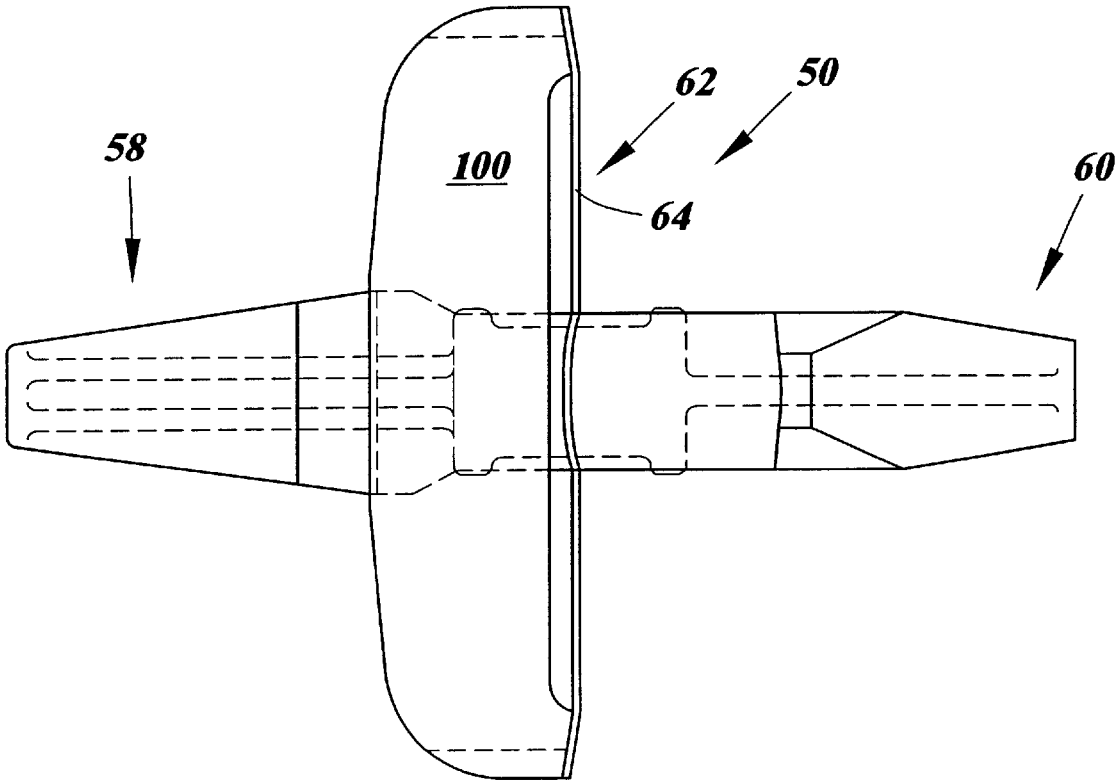

As shown in FIGS. 6, 7 and 8, the retractable dog 50 may also include one or more areas to which a sound abating material is applied. The retractable dog 50 may include first and second cam portions 58, 60 disposed at the opposite ends of the retractable dog 50, a stem 52 disposed perpendicularly with respect to the cam portions 58, 60, and a wing 110 disposed between the two end portions 58, 60. The wing 110 is perpendicular to both the cam portions 58, 60 and the stem 52. The wing 110 may include an area 62 to which a sound abating material 64 may be applied. This area 62 on the wing 110 is where the wing 110 contacts the pusher dog 16.

Additionally or alternatively, as shown in FIGS. 6 and 7, a sound abating material 66 may be applied to areas 68 on the stem 52 of the retractable dog 50 where the stem 52 contacts the channel 24 of the trolley body 20 during a collision. While there is little direct contact between the stem 52 and the channel 24 in these areas 68, sliding contact does occur. It has been discovered that application of a sound abating material to these areas 68 of the stem 52 contributes to sound abatement.

The sound abating material 66 may be applied to the areas 68 of the stem 52 in various manners. The preferred method is to apply the sound abating material 66 to a recess 70 on the stem 52 so that the overall dimensions of the stem 52 do not change to inhibit its travel in the channel 24, although the sound abating material 66 may extend slightly beyond the surfaces of the stem 52 without interfering with stem travel. In the illustrated embodiment, a piece of sound abating material 66, which has the configuration of a sheet or pad, is attached to each area 68 on the stem 52 in a manner similar to how the member 46 is attached to the cam lever 30 as shown in FIGS. 3 and 4. Each piece of sound abating material 66 includes one or more stems 72, which are inserted into bores 74 in the stem 52 for an interference fit.

Figure 9A:
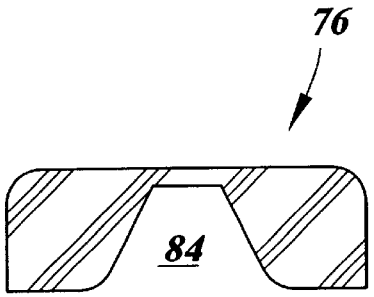
FIGS. 9A to 9D are cross section views of the sound abating material along lines A—A, B—B, C—C and DD of FIG. 6.
Figure 9B:
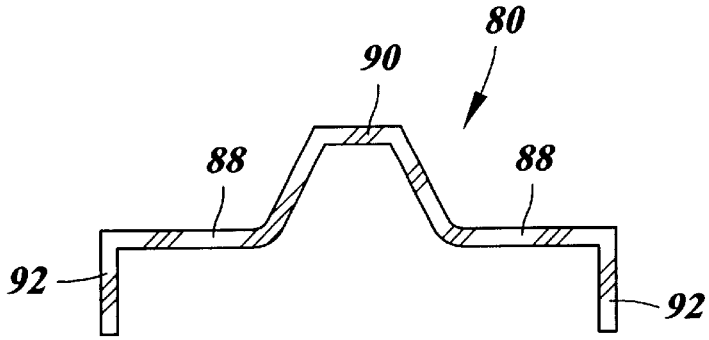

Further, a sound abating material may be applied to certain contact and non-contact areas on the first cam portion 58 of the retractable dog 50. In the embodiment illustrated in FIGS. 6 and 7, a sound abating material 76 is applied to a non-contact area 78, and another piece of sound abating material 80 is applied to a contact area 82 that comes in contact with the trolley body 20 when the retractable dog 40 retracts into the channel 24. The sound abating material 76 applied to the non-contact area 78 has a generally rectangular configuration, as shown in FIG. 9A, and is placed on the top of the cam portion 58. This piece of sound abating material 76 includes a groove 84 to accommodate a ridge 86 atop the cam portion 58. The sound abating material 80 applied to the contact area 82 is also configured to accommodate the configuration of the cam portion 58, as shown in FIG. 9B. The sound abating material 80 has the configuration of a sheet with two horizontal sections 88 attached to the top of the cam portion 58, a section 90 between the two horizontal sections 88 to accommodate the ridge 86 atop the cam portion 58, and two vertical sections 92 attached to the sides 94 of the cam portion 58. The sound abating material 76, 80 applied to the first cam portion 58 acts as a damper to reduce the ringing associated with the cam portion 58 since the cam portion 58 functions similar to a tuning fork when the trolley 10 collides with another trolley.

Figure 9C:
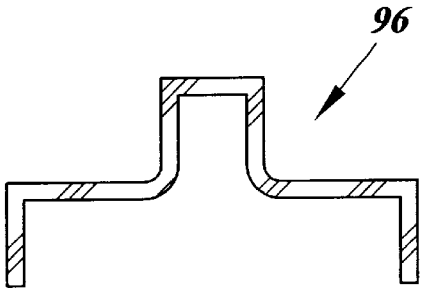
Figure 9D:
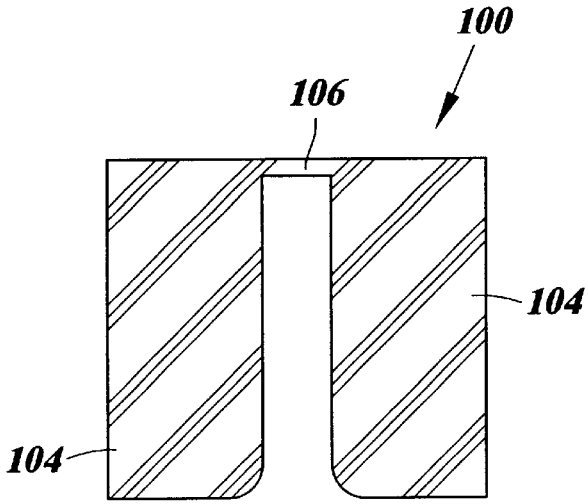

Similarly, a sound abating material may be applied to non-contact and contact areas of the second cam portion 60 of the retractable dog 50. For example, a sound abating material 96 may be applied to a contact area 98 of the second cam portion 60. This contact area 98 of the retractable dog 50 contacts the trolley body 20 when the retractable dog 50 retracts into the channel 24. As shown in FIG. 9C, this sound abating material 96 is similar to the material 80 applied to the contact area 82 of the first cam portion 58. Thus no further description of the sound abating material 96 is provided. A sound abating material 100 is also applied to a non-contact area 102 of the second cam portion 60. As shown in FIG. 9D, this piece of sound abating material 100 has a generally rectangular configuration with two relatively thick vertical sections 104 and a relatively thin horizontal section 106 connecting the two vertical sections 104 at the top. This piece of sound abating material 100 is attached to a ridge 108 atop the second cam portion 60, with the two vertical sections 102, 104 attached to the sides of the ridge 108 and the horizontal section 106 attached to the top of the ridge 108.

In the present embodiment, when there is contact between two components of the trolley 10, such as the contact between the trolley body 20 and the retractable dog 50, the sound abating material generally is only applied to one of the two components, such as the retractable dog 50. Alternatively, the sound abating material may be applied only to the other component of the trolley 10 or to both components.

A sound abating material may be applied to an area of the trolley in various manners. The application of a sound abating material may include attachment of a sound abating material to a contact or non-contact area on a trolley by means of spray coating and/or adhesives. Alternatively, a sound abating material may be more loosely attached to an area of a trolley. For example, as shown in FIGS. 3 and 4, a sound abating material functioning as a cushion may be attached to a trolley by means of an interference fit between one or more stems and corresponding bores in which the stems are disposed. In accordance with a preferred method of attaching a sound abating material, the material may be molded into a configuration that conforms to the area of the trolley, to which the material is to be attached. The molded sound abating material can then be secured to the area of the trolley using any suitable attaching methods, such as by using adhesives. Preferably, the area to which the sound abating material is attached may be machined and/or polished to create a smooth surface for effective attachment. The thickness of the molded sound abating material may vary depending on the application. In some applications, the sound abating material may have the configuration of a thin sheet, while in other applications the sound material may be thicker, having the configuration of a pad or a block, for example.

The sound abating materials may perform various functions. The functions performed by a sound abating material may include the functions of a cushion, a noise and vibration damper and/or a noise and vibration insulator. The sound abating materials used in the present invention may be any materials suitable to perform one or more of these functions. Suitable materials may include, for example, any resilient materials, such as rubber and polymeric materials. Preferably, the sound abating material has sufficient strength to be securely attached to an area of the trolley and is sufficiently resilient for effective sound abatement. An example of preferred sound abating materials is polyurethane with any suitable durometer readings, preferably within the range of 60 to 90, more preferably within the range of 70 to 80. In some applications, polyurethane with durometers greater than 90 may not provide effective sound abatement, while polyurethane with durometers less than 60 may not have sufficient strength to be securely attached to an area of the trolley. In other applications, however, polyurethane having a durometer outside of the range of 60 to 90 may be an effective sound abating material.

Another aspect of the invention is a sound abatement method for reducing noises generated trolley collisions. The method may include applying a sound abating material to one or more areas on one or more trolley components. As discussed above, the sound abating material may be applied to these area using any suitable methods, and these areas may be include contact and non-contact areas.

Tests

Tests were conducted to determine the level of sound abatement achieved by conveyor trolleys with polyurethane sound abating material.

Test Description Summary

Standard 4" dog magic trolleys were compared to sound deadened trolleys in a 4" inverted straight track setup. The following components were used in the sound deadened trolley assemblies: a 4" inverted trolley assembly with a bumper; and urethane molded/bonded to the retractable dog as depicted in FIGS. 1 to 9. The modified trolleys were designated as new and retrofit (new=molded and retrofit=bonded).

Sound deadened 4" inverted cam levers had urethane filled cavities and coated tangs as shown in FIGS. 1 to 9. The new and retrofit designs also applied to the 4" inverted cam lever. The rest of the components used were standard equipment. Vendors provided sets of 6 dogs and 6 cams (1 retrofit set and 2 new sets). Manufacturer, Polyflex, Inc., bonded the retrofit set, and manufacturers, Kastalon and Winfield, molded new sets.

In order to obtain the sound levels emitted by the 4" trolley assemblies, a comparable 4" inverted system was created. A 4" inverted track assembly was used with the pusher, cylinder, and loaded trolleys to produce similar sound levels to a 4" inverted system. The steel trolleys and urethane fitted trolleys were then compared.

Sound measurement parameters included: equivalent continuous sound level with exchange rate of 5 dB, RMS levels exceeded 10%, 50%, and 90% of the time, peak levels, maximum SPLs, and minimum SPLs.

Objective

To obtain the noise levels of the 4" inverted retractable dogs engaging with the pusher dogs of the lead trolley being stopped by the stop blade, and of the secondary trolley banking into the lead trolley. In other words, to obtain the sound levels in a 4" inverted test stand that are comparable to a 4" inverted system. Another objective was to compare steel vs. urethane coated components to see if there is a sound abatement in the latter.

Acceptance Criteria

With the goal of reducing overall system sound, it will be acceptable if a certain dBA "customer to determine" noise reduction is accomplished with the following sound deadened components: 4" inverted dog magic trolley assembly, an inverted cam lever, and urethane molded/bonded to the inverted retractable dog and lever.

Procedure

Setup for this test stand included bolting a 6" bore air cylinder, which was used to actuate the pusher, to the straight track. The cylinder rod was connected to the pusher weldment with a 1" dia pin. The speed of the cylinder was set to 60 ft/min (3 ft. of cylinder travel in 3 seconds), without load. The line pressure used in the test was from shop air. The pressure from the tank on the mezzanine read 120 psi. The pressure read from the floor at the test stand was 110 psi. Note: the regulator was set all the way open. No flow controls or exhaust metering devices were used in the air circuit.

Two sets of two trolleys were installed into the system with 850 lbs. on each pair. The lead trolleys had inverted retractable dogs while the trailing trolley did not. They were positioned the same each time for pusher pick up. That position was 3" before the pusher dog engages the inverted retractable dog for both lead trolleys. The test was repeated with consistent positioning of trolleys for each pick up.

Ambient noise levels were taken twice at each new position. Noise readings were obtained for cylinder only operation with the three position valve (control valve with lever). To do this, the trolleys were banked into the stop blade and the cylinder was run back and forth twice while sound testing. Next, the pusher was put into the back position ready for pick up. The trolleys experienced the following sequence. First, the trolleys were "picked up" by the pusher. Then, the lead trolley was stopped by a blade mounted to the track. Finally, the trailing trolley assembly was banked into the lead assembly. That finished the sequence of the sound test. This sequence was repeated 10 times at each position.

Data & Results

| Manufacturer of coating | SPL Average |
|---|---|
| Polyflex | 83.7 dBA |
| Kastalon | 84.3 dBA |
| Winfield | 84.0 dBA |
| Steel | 86.1 dBA |

CONCLUSIONS

Trolleys were compared with these differences: steel bumper, steel cam, and steel dog vs. urethane bumper, urethane coated cam and dog. The results from these two configurations showed that the urethane coated trolleys were on average 2dBA lower sound level than the steel. The sound test did not differ more than 0.5 dBA between different manufacturers of sound deadened dogs and cams. This can be explained by the impulse nature of the impact of 850 lb. loads being significantly louder than the engagement of the inverted retractable dog with the chain dog. In other words, the dynamics of the 850 lb. loads stopping produce more noise than anything else going on in this system. Moreover, the lead steel trolley of the secondary pair hitting the steel trolley of the lead pair is louder than the other three tests with a urethane bumper to soften the impact of the loads. Therefore, noting that there are differences in the sound levels emitted by a struck sound deadened inverted retractable dog and due to the fact that the these differences did not significantly surface during sound testing, this leads to the conclusion that the urethane trolley used on the three sound deadened configurations precipitated the difference in sound levels in this test. Future considerations should include an entire stop, not just a stop blade, for accurate sound levels of a trolley experiencing a stop.

What is claimed is:

1. A method for abating sound generated during the disengagement of a moving trolley from a pusher dog by collision between the moving trolley and a stopped trolley, the method comprising applying a sound abating material to an area of a component of at least one of the moving and stopped trolleys, wherein the component is not a bumper.

2. A method for abating sound generated during the disengagement of a moving trolley from a pusher dog by collision between the moving trolley and a stopped trolley, the method comprising applying a sound abating material to an area of a component of at least one of the moving and stopped trolleys, wherein applying a sound abating material to an area of a component of at least one of the moving and stopped trolleys includes applying the sound abating material to an area of a cam lever of the moving trolley.

3. The method of claim 2, wherein the area of the cam lever includes an area which contacts a body of the moving trolley.

4. The method of claim 2, wherein the area of the cam lever includes an area which contacts an accumulation cam of the stopped trolley.

5. The method of claim 2, wherein the area of the cam lever includes an area which contacts a retractable dog of the moving trolley.

6. A method for abating sound generated during the disengagement of a moving trolley from a pusher dog by collision between the moving trolley and a stopped trolley, the method comprising applying a sound abating material to an area of a component of at least one of the moving and stopped trolleys, wherein applying a sound abating material to an area of a component of at least one of the moving and stopped trolleys includes applying the sound abating material to an area of a retractable dog of the moving trolley.

7. The method of claim 6, wherein the area of the retractable dog includes an area which contacts a body of the moving trolley.

8. The method of claim 6, wherein the area of the retractable dog includes an area which contacts a cam lever of the moving trolley.

9. The method of claim 6, wherein the area of the retractable dog includes an area which contacts the pusher dog.

10. A method for abating sound generated during the disengagement of a moving trolley from a pusher dog by collision between the moving trolley and a stopped trolley, the method comprising applying a sound abating material to an area of a component of at least one of the moving and stopped trolleys, wherein applying a sound abating material to an area of a component of at least one of the moving and stopped trolleys includes applying the sound abating material to an area of an accumulation cam of the stopped trolley.

11. A method for abating sound generated during the disengagement of a moving trolley from a pusher dog by collision between the moving trolley and a stopped trolley, the method comprising applying a sound abating material to an area of a component of at least one of the moving and stopped trolleys, wherein applying a sound abating material to an area of a component of at least one of the moving and stopped trolleys includes applying the sound abating material to an of a body of the moving trolley where the body contacts a cam lever of the moving trolley.

12. A method for abating sound generated during the disengagement of a moving trolley from a pusher dog by collision between the moving trolley and a stopped trolley, the method comprising applying a sound abating material to an area of a component of at least one of the moving and stopped trolleys, wherein applying a sound abating material to an area of a component of at least one of the moving and stopped trolleys includes applying the sound abating material to an area of a body of the moving trolley where the body contacts a retractable dog of the moving trolley.

13. The method of claim 1, wherein the area includes an area of direct contact.

14. A method for abating sound generated during the disengagement of a moving trolley from a pusher dog by collision between the moving trolley and a stopped trolley, the method comprising applying a sound abating material to an area of a component of at least one of the moving and stopped trolleys, wherein the area includes an area of sliding contact.

15. The method of claim 1, wherein the area includes an non-contact area.

16. The method of claim 1, wherein the application of the sound abating material includes coating the sound abating material.

17. The method of claim 1, wherein the application of the sound abating material includes molding the sound abating material into a shape and attaching the shape to at least one area.

18. The method of claim 15, wherein the non-contact area includes a cavity, and the application of the sound abating material to the non-contact area includes filling the cavity with the sound abating material.

19. The method of claim 1, wherein the sound abating material is a polyurethane.

20. The method of claim 19, wherein the polyurethane sound abating material has a durometer of between around 60 and 90.

21. A trolley comprising:

a trolley body having at least one wheel for traveling in a track; and a component cooperatively associated with the trolley body, the component having an area and a sound abating material applied to the area for sound abatement, wherein the component is not a bumper.

22. A trolley comprising:

a trolley body having at least one wheel for traveling in a track; and at least one component cooperatively associated with the trolley body, the component having an area and a sound abating material applied to the area for sound abatement, wherein the at least one component including:

a cam lever pivotally mounted to the trolley body, the cam lever being moveable between first and second positions;

a retractable dog movable by the cam lever; and an accumulation cam cooperatively associated with the trolley body; and wherein at least one of the cam lever, retractable dog, and the accumulation cam includes the at least one area and the sound abating material applied to the area for sound abatement.

23. The trolley of claim 21, wherein the trolley body has an area and a sound abating material applied to the area of the trolley body for sound abatement.

24. The trolley of claim 22, wherein the cam lever includes an area and the sound abating material applied to the area of the cam lever for sound abatement, and the area of the cam lever includes an area which is engageable with an accumulation cam of another trolley.

25. The trolley of claim 24, wherein area of the cam lever includes an area which contacts a body of the trolley.

26. The trolley of claim 24, wherein the area of the cam lever includes an area which contacts a retractable dog of the trolley.

27. The trolley of claim 22, wherein the retractable dog includes an area and a sound abating material applied to the area of the retractable dog for sound abatement.

28. The trolley of claim 27, wherein the area of the retractable dog includes an area which contacts a body of the trolley.

29. The trolley of claim 27, wherein the area of the retractable dog includes an area which contacts a cam lever of the trolley.

30. The trolley of claim 27, wherein the area of the retractable dog includes an area which contacts the pusher dog.

31. The trolley of claim 21, wherein the area includes an area of direct contact.

32. A trolley comprising:

a trolley body having at least one wheel for traveling in a track; and a component cooperatively associated with the trolley body, the component having an area and a sound abating material applied to the area for sound abatement, wherein the area includes an area of sliding contact.

33. The trolley of claim 21, wherein the area includes a non-contact area.

34. The trolley of claim 21, wherein the application of the sound abating material includes coating the sound abating material.

35. The trolley of claim 21, wherein the application of the sound abating material includes molding the sound abating material into a shape and attaching the shape to at least one area.

36. The trolley of claim 33, wherein the non-contact area includes a cavity, and the application of the sound abating material to the non-contact area includes filling the cavity with the sound abating material.

37. The trolley of claim 21, wherein the sound abating material is a polyurethane.

38. The trolley of claim 37, wherein the polyurethane sound abating material has a durometer of between around 60 and 90.

39. An element used in a conveyor trolley including a trolley body, the element comprising:

an area; and a sound abating material applied to the area for sound abatement, wherein the element does not include a bumper.

40. The element of claim 39, wherein the area includes a contact area.

41. The element of claim 39, wherein the area includes a non-contact area.

42. The element of claim 39, further including a cam lever.

43. The element of claim 39, further including a retractable dog.

44. The element of claim 39, further including an accumulation cam.

* * * * *